US005275300A

United States Patent [19]

Johnson

[11] Patent Number: 5,275,300

[45] Date of Patent: Jan. 4, 1994

[54] GRAPE OR FRUIT CARTON

[75] Inventor: Larry R. Johnson, Hoquiam, Wash.

[73] Assignee: Anderson & Middleton Company, Hoquiam, Wash.

[21] Appl. No.: 973,028

[22] Filed: Nov. 10, 1992

[51] Int. Cl.[5] ..... B65D 43/04

[52] U.S. Cl. ..... 217/5; 217/40; 217/56; 220/305; 220/4.28

[58] Field of Search ..... 217/40, 56, 62, 43 R, 43 A, 42, 12 R, 11, 5; 220/305, 4.28, 307, 213

[56] References Cited

U.S. PATENT DOCUMENTS

| | | | |
|---|---|---|---|
| 390,135 | 9/1888 | Morey | 217/62 |
| 404,880 | 6/1889 | Wheat | 217/62 |
| 1,789,075 | 1/1931 | Kawasaki | 217/56 |
| 2,253,726 | 8/1941 | Roumillat | 217/56 |
| 2,357,162 | 8/1944 | Barbour | 217/40 |
| 2,566,500 | 9/1951 | Rose et al. | 217/40 |
| 2,759,619 | 8/1956 | Barbour | 217/40 |
| 2,789,748 | 4/1957 | Barbour | 217/40 |

FOREIGN PATENT DOCUMENTS

| | | | |
|---|---|---|---|
| 12301 | 5/1933 | Australia | 217/40 |
| 964956 | 8/1950 | France | 217/36 |

*Primary Examiner*—Allan N. Shoap
*Assistant Examiner*—S. Castellano
*Attorney, Agent, or Firm*—Nixon & Vanderhye

[57] ABSTRACT

A grape or fruit box includes a pair of laterally spaced, rigid ends, to which is secured a wrap assembly of paper overlay laminated veneer, extending substantially about the sides and bottom of the box. The ends are each formed with a groove extending from the right to left side of the end, and relatively closely adjacent the upper edge of the end. The groove extends parallel to the upper side of the end, and the lower edge of the groove is chamfered or bevelled along its entire length. The box lid or cover pad comprises a relatively thin and flexible sheet of laminated veneer or heavyweight paper. To secure the cover pad to the box, one end of the lid may be inserted in one groove of one end, and the lid then bowed upwardly in its center area, so that the opposite end of the lid may be located below the groove in the opposite end. By then pulling upwardly on that opposite pad end, the latter will snap into the groove, facilitated by the lower, chamfered edge of the groove.

16 Claims, 3 Drawing Sheets

GRAPE OR FRUIT CARTON

This invention relates to food cartons in general, and in particular to a carton particularly suited for use in the field during harvesting of grapes or other small fruits.

BACKGROUND

There is currently a grape or fruit box in widespread use which nevertheless has certain disadvantages in terms of the number of parts required to make the box, its manner of assembly, and its ease of use in the field. This well known box construction is illustrated in FIG. 1 at 10 and includes a pair of wood ends 12 and 14 (angled at all four corners) connected by a wrap assembly 16 which forms a bottom wall 18 and a remaining pair of opposed sides 20, 22. The wrap 16 is typically constructed of three relatively rigid sheets of wood veneer 18*a*, 20*a* and 22*a* which are used to form the sides 20, 22 and the box bottom wall 18, respectively. These sheets are covered with Kraft paper shown at 16*a*, and nailed or stapled to the lower edges respectively of ends 12, 14 (one such edge shown at 24) as well as along the front and back edges 26, 28 of end 14 and corresponding edges (one shown at 30) of end 12. The sides 20, 22 terminate short of the upper edges of the ends 12 and 14 to insure adequate ventilation. The wrap 16 may also include a plurality of ventilation apertures (not shown) in the areas between the veneer sheets.

In this commonly utilized construction, the upper edges of ends 12, 14, (one shown at 32) are each provided with a pair of nails 34, 36 and 38, 40 all of which extend upwardly from their respective associated edges a carefully chosen, uniform height.

A box lid 42, typically formed of a 1/20" thick veneer laminated with paper on either side, is stitched, stapled or otherwise secured to a pair of upper side cleats 44, 46 which may be nominal 2 inch×1 inch strips of wood. The cleats may be 11½ inches in length, extending from side to side at the ends of the box, whereas the ends 12, 14 may be 13½ inches in length. Cleats 44 and 46 are each provided with a pair of vertical slots (one pair shown at 48, 50) which open away from the respective ends of the box. It will be appreciated that the flexible nature of the lid 42 permits the lid to be bowed upwardly to thereby allow the lid to be placed on the box with nails 38, 40 received in slots 48, 50 and nails 34, 36 then received in similar but unseen slots in the cleat 44. With this arrangement, the nails and slots retain the lid 42 in place on the box 10 until such time as the lid is pulled upwardly a distance sufficient to dislodge at least one pair of nails from their associated slots in one of the upper cleats. The upward bowing of the lid also accommodates a level of contents in the box which exceeds in some areas the upper edges of the ends 12 and 14.

Bottom cleats 52, 54 are fixed to the lower edges of ends 12, 14, and provide a stacking base which will be aligned with and supported by a pair of upper cleats on an underlying box.

With the above described construction, it will be apparent that the precise matching of nail location to cleat slot location is critical to the ability of the box to function in its desired manner. The presence of nails 34, 36 and 38, 40 during initial shipment to the site of adjacent boxes is cumbersome and can result in damage to adjacent boxes. Of course, the loss of any of the nails renders the lid incapable of adequate securement to the box. Finally, the box/lid assembly as described above requires the addition of the bottom cleats 52, 54 to facilitate stacking after the boxes have been filled and lids applied, i.e., to provide sufficient clearance to avoid crushing the upwardly bowed lid of the box immediately below.

SUMMARY OF THE INVENTION

The grape or fruit box in accordance with this invention eliminates the disadvantages of the above described conventional box by reducing the number of parts, simplifying the assembly process, and by improving overall reliability and durability.

In the exemplary embodiment, the box includes a pair of laterally spaced, rigid ends, to which is secured a wrap assembly of veneer (or other suitable material), extending substantially about three sides of the box much like the conventional construction. Unlike the conventional construction, however, the ends are each formed with a groove extending from the left side to the right side of the end, and relatively closely adjacent the upper edge of the end. The groove extends parallel to the upper edge of the end, and the lower edge of the groove is chamfered or bevelled along its entire length, for reasons given in detail below.

The box lid or cover pad comprises a relatively thin and flexible sheet preferably of veneer, heavyweight paper or other suitable material. To secure the cover pad to the box, one end of the cover pad may be inserted in one groove of one end, and the cover pad then bowed upwardly in its center area, so that the opposite end of the cover pad may be located below the groove in the opposite end. By then pulling upwardly on the opposite end of the cover pad, the latter will snap into the groove, facilitated by the lower, chamfered edge of the groove.

Thus, in one aspect, the invention provides in a box construction for use in harvesting grapes and tree fruit, with the box formed by a pair of wood ends connected by a member forming sides and bottom of the box, an improvement comprising a pair of elongated grooves, one provided in an interior surface of each of the ends, the grooves extending parallel to and proximate the upper edges of the ends, and a flexible cover pad removably secured to the box, the cover pad having end and side edges, the end edges received in respective ones of the grooves provided in the ends.

In another aspect, the invention provides a box construction comprising a pair of ends, a pair of sides and a bottom, the sides having upper edges located below upper edges of the ends, each of the ends having an elongated groove located between the upper edge of the respective end and the upper edges of the sides, and a flexible cover pad removably secured within the grooves.

In still another aspect, the invention provides a box construction for use in harvesting grapes and other small fruits, the box comprising a pair of ends connected by sides and a bottom formed by a flexible paper overlay veneer wrap which terminates at upper edges of the sides which are located below upper edges of the ends, each of the ends having an elongated groove located between the upper edge of the respective end and the upper edges of the sides, and a flexible cover pad removably secured within the grooves.

Additional objects and advantages of the invention will become apparent from the detailed description which follows.

DETAILED DESCRIPTION OF THE DRAWINGS

Figure 1:
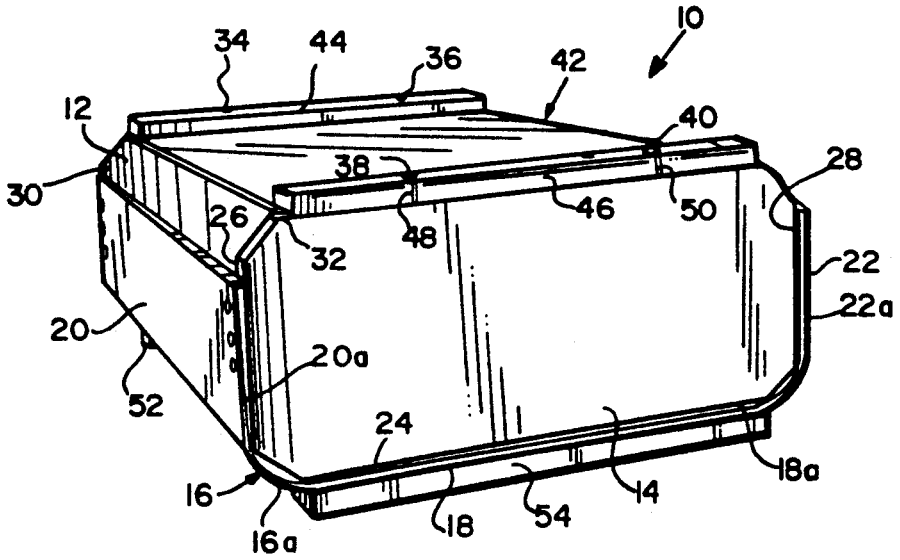
Fig. 1 (PRIOR ART)
FIG. 1 is a perspective view of a conventional grape or fruit box.
Figure 2:
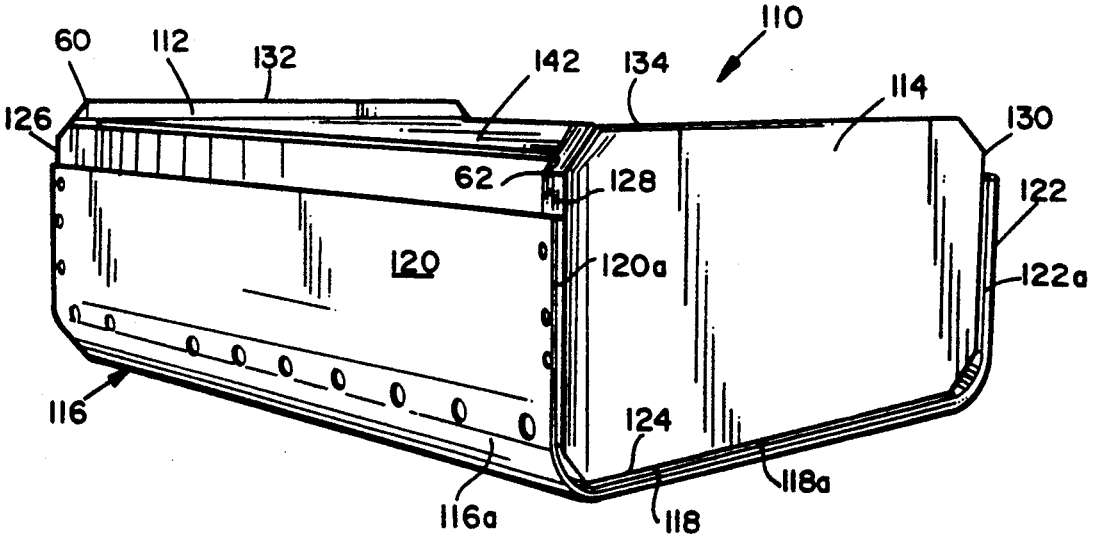
FIG. 2 is a perspective view of a grape or fruit box in accordance with an exemplary embodiment of this invention.
Figure 3:
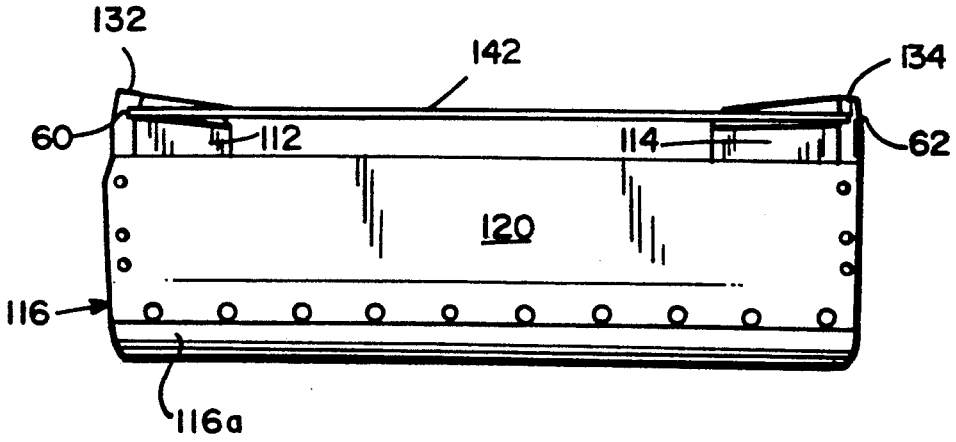
FIG. 3 is a side elevation of the box shown in FIG. 2.

With reference now to FIGS. 2 and 3, the box 110 in accordance with this invention includes a pair of rigid ends 12 and 14 which are held in laterally spaced relationship by a wrap assembly 116 which forms a bottom 118 and a remaining pair of opposed sides 120 and 122. The wrap assembly 116 may be constructed of similar veneer sheets 18*a*, 20*a* and 22*a* covered by Kraft paper 116*a* as in the conventional grape and fruit box construction described above, or other suitable material. The wrap assembly, having a varied thickness (⅛"–1/10" or similar) may be nailed or stapled to the bottom edges respectively of ends 112, 114 (one such edge shown at 124), as well as along the front and back edges of end 112 (one shown at 126) and corresponding edges 128, 130 of end 114. To this extent, the box in accordance with this invention is similar to the conventional box with the exception that the ends 112 and 114 have an increased height dimension. In other words, whereas the ends in the conventional box construction are each usually 5½ inches in height (the height of the box and lid assembly is 6½ inches when the upper and bottom cleats are considered), the ends 112, 114 of the box in accordance with this invention have been increased to a dimension where no cleats are required. To the extent ends 112, 114 extend above the cover pad (described below), the latter may be bowed upwardly to accommodate the contents of the box, as described below.

Each of the ends 112 and 114 is formed with an elongated groove 60, 62, respectively, extending parallel to, and relatively closely adjacent (about ½ inch below), the upper edges 132, 134 of the ends 112, 114. These grooves, each having a height of about ⅛ inch (also see FIGS. 5 and 6), extend along the entire length of the ends 112, 114 from side to side, and are adapted to receive the box cover pad 142 as described below.

Figure 5:
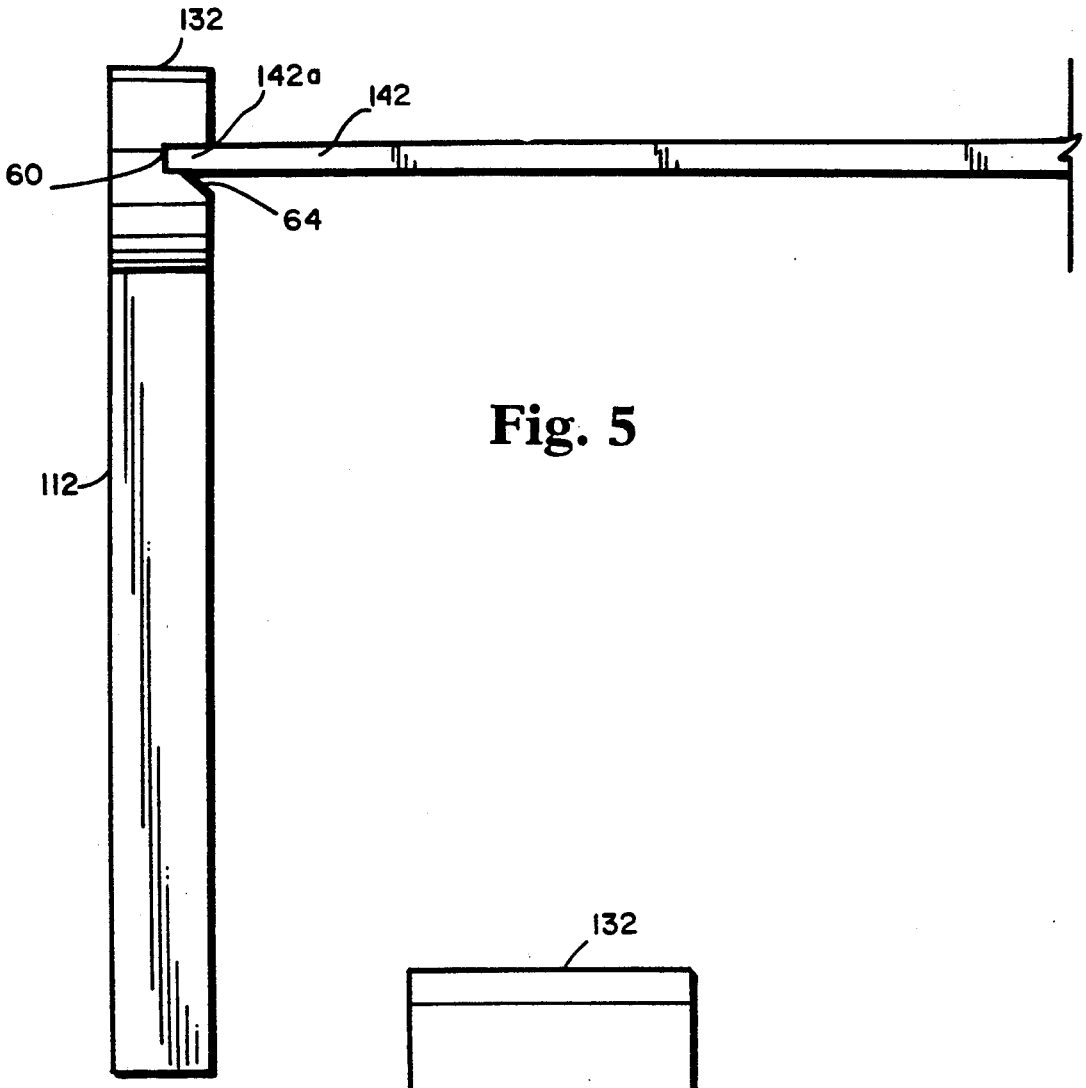
FIG. 5 is an enlarged, partial detail of the joint between the cover pad and one end of the box in accordance with this invention.
Figure 6:
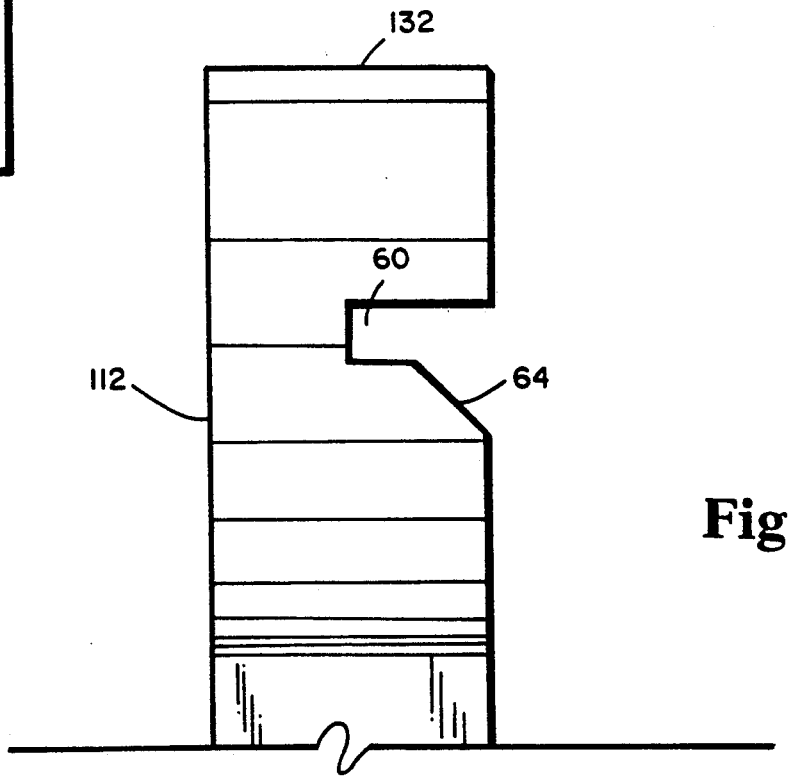
FIG. 6 is an enlarged detail of the end groove shown in FIG. 5.

The box cover pad 142 is a relatively flexible sheet of material constructed of a laminated veneer (paper over wood) or heavyweight paper (or other suitable material), having side and end edges (one shown at 142*a* in FIG. 5). The cover pad, which may be between about 1/10 and 1/30 of an inch thick, is secured to the box 110 as follows. An end of the cover pad, e.g., 142*a*, is inserted into, for example, groove 60 and the cover pad 142 is then bowed upwardly in its center area, so that the opposite edge of the cover pad may be located below the opposite groove 62. The end of the cover pad adjacent groove 62 may then be pulled upwardly until it snaps into the groove 62. To facilitate the assembly process, and with further reference to both FIGS. 5 and 6, each groove 60, 62 is formed along its lower edge with a chamfer or bevel 64 (one shown in FIGS. 5 and 6), preferably formed at a 45° angle, relative to horizontal. Removal of the cover pad may be achieved by an upward pulling on the center area of the cover pad until one of its ends becomes disengaged from its respective groove.

As will be appreciated by those skilled in the art, the box 10 in accordance with this invention eliminates the cumbersome lid attachment mechanism of the conventional box by eliminating the need for nails and eliminating the need for both upper and lower cleats.

Figure 4:
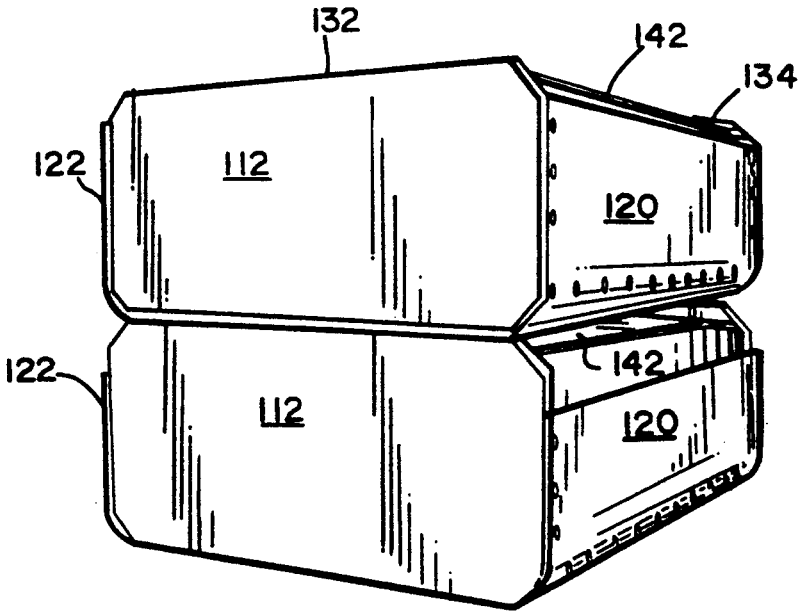
FIG. 4 is a perspective view of a pair of boxes in stacked relationship, each box like those shown in FIGS. 2 and 3.

With reference to FIG. 4, it will be appreciated that the box construction in accordance with this invention also permits easy stacking, with the lower edges of ends 112, 114 of one box, supported on the upper edges of similar ends on an underlying box, while permitting some upward bowing of the cover pad 142.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a box for use in harvesting small fruit, the box formed by a pair of wood ends connected by a member forming sides and a bottom, the improvement comprising:

a pair of elongated grooves, one provided on an interior surface of each of said wood ends, the grooves extending parallel to and proximate upper edges of said ends wherein each of said grooves is bevelled downwardly along a lower horizontal edge thereof, substantially the entire length of the groove; and a flexible cover pad removably secured to the box, said cover pad having end and side edges, said end edges received in respective ones of said grooves provided in said ends.

2. The box of claim 1 wherein said member comprises wood veneer and a paper overlay.

3. The box of claim 1 wherein said cover pad comprises a flexible but relatively stiff material.

4. The box of claim 1 wherein said ends each has a height of about 6½ inches, and wherein said elongated grooves are located about ½ inch from upper edges of said ends.

5. The box of claim 4 wherein each said groove is about ⅛ inch in height.

6. The box of claim 1 wherein each said groove is bevelled at an angle of about 45°.

7. A box construction comprising:

a pair of ends, a pair of sides, and a bottom, said sides having upper edges located below upper edges of said ends, each of said ends having an elongated groove located between the upper edge of the respective ends and the upper edges of said sides wherein each of said grooves has upper and lower horizontal edges, a portion of the lower edge being bevelled downwardly toward the interior of the box; and a flexible cover pad removably secured within said grooves.

8. The box construction of claim 7 wherein said cover pad comprises a relatively stiff but flexible material.

9. The box construction of claim 7 wherein said lower edge is bevelled at an angle of about 45°.

10. The box construction of claim 7 wherein said ends each has a height of about 6½ inches, and wherein said elongated grooves are located about ½ inch from upper edges of said ends.

11. The box construction of claim 7 wherein each said groove is about ⅛ inch in height.

12. A box for use in harvesting grapes and other small fruits, said box comprising a pair of ends connected by sides and a bottom, said sides and bottom formed by a flexible paper overlay veneer wrap, wherein said sides have upper terminal edges located below upper edges of said ends; each of said ends having an elongated groove located between the upper edge of the respective end and the upper edges of said sides wherein each of said grooves has upper and lower horizontal edges, a portion of the lower edge being bevelled at an angle of about 45°; and a flexible cover pad removably secured within said grooves.

13. The box of claim 12 wherein said ends each has a height of about 6½ inches, and wherein said elongated grooves are located about ½ inch from upper edges of said ends.

14. The box of claim 12 wherein each said groove is about ⅛ inch in height.

15. The box construction of claim 12 wherein said cover pad is between about 1/10 and 1/30 of an inch thick.

16. The box of claim 12 wherein said cover pad comprises a laminated veneer.

* * * * *